United States Patent [19]

Gusinde et al.

[11] Patent Number: 4,759,499

[45] Date of Patent: Jul. 26, 1988

[54] MOTOR VEHICLE ENGINE COOLING SYSTEM

[75] Inventors: Heinz Gusinde, Weichs; Horst Steinert, Grossinzemoos, both of Fed. Rep. of Germany

[73] Assignee: MAN Nutzfahrzeuge GmbH, Munich, Fed. Rep. of Germany

[21] Appl. No.: 50,637

[22] Filed: May 13, 1987

[30] Foreign Application Priority Data

Jun. 28, 1986 [DE] Fed. Rep. of Germany ..... 621837

[51] Int. Cl.[4] ..... G05D 23/00

[52] U.S. Cl. ..... 237/12.3 B; 123/41.44

[58] Field of Search ..... 237/66, 12.3 B, 12.3 A; 123/41.02, 41.15, 41.44, 41.48; 55/36, 39

[56] References Cited

U.S. PATENT DOCUMENTS 3,195,294 7/1965 Verdura et al. ..... 237/66

FOREIGN PATENT DOCUMENTS 1426185 2/1970 Fed. Rep. of Germany .

7611054 9/1976 Fed. Rep. of Germany .

*Primary Examiner*—Henry A. Bennet

*Attorney, Agent, or Firm*—Scully, Scott, Murphy & Presser

[57] ABSTRACT

A bubble trap is arranged in the cooling system of a water-cooled engine between the radiator and the water pump. The bubble trap is connected via a duct with the cooling water level compensating tank and is designed to contain at least three times the amount of water corresponding to the cross section of the inlet of the water pump. The opening of the heater circuit into the line connecting the bubble trap with the radiator is arranged a short distance upstream from the bubble trap.

4 Claims, 3 Drawing Sheets

MOTOR VEHICLE COOLING SYSTEM

BACKGROUND OF THE INVENTION

The invention relates to automobile engine cooling systems using liquid as a coolant and comprising a radiator, a coolant pump, an coolant level compensating tank, a heating element of an engine de-aerating system and various automatic control and connecting elements.

Proposals have been made to include bubble traps in liquid cooling system (see German examined specification No. 2,615,728 and German unexamined specification No. 2,615,729). They are integrated in the control or thermostat valve. They are however far too high up in relation to the coolant pump and do not have any large-volume settling space in which the coolant flow speed may be reduced so that air bubbles are absorbed.

SHORT OVERVIEW OF THE INVENTION

Accordingly one object of the present invention is to so arrange and construct a bubble trap that optimum separation of air bubbles may be ensured with simple means.

In order to achieve this or other objects of the invention, a bubble trap is arranged between the radiator and the coolant pump and it is connected via a duct with the coolant level compensating tank, said bubble trap being able to contain at least three times the amount of liquid corresponding to the cross section of the inlet of the coolant pump.

This arrangement of the bubble trap causes a marked reduction in the flow velocities of the coolant so that air bubbles are conducted away directly before they are able to be swirled by the coolant pump into the coolant level compensating tank (topping up container) and they do not have a chance of entering the engine cooling circuit. This avoids cavitation damage involving partial destruction of engine components (wearing surfaces of the cylinders, pistons etc.) which might cause complete engine failure if it occurred. In addition to the reduction of the flow velocity of the coolant, the design of the bubble trap with a large volume means that there can be no induction through the de-aerating duct.

It is an advantage if the inlet of the heating circuit into the duct system is provided upstream from the bubble trap. This causes the entire cooling system to be even more swiftly freed of bubbles.

In accordance with a preferred feature of the invention, the bubble trap extends from a broad base, into which the connecting ducts for the radiator and the coolant pump open, convergingly to the duct forming a connection with the coolant level compensating tank. It is in this way that the air bubbles are forced to coalesce with an increasing upward flow velocity so that there is a further useful effect on the de-aeration. The optimum flow of air bubbles to the level compensating tank is produced by a conical design of the bubble trap.

Two embodiments of the invention will now be described in more detail with reference to the drawings.

DETAILED ACCOUNT OF INVENTION

Figure 1:
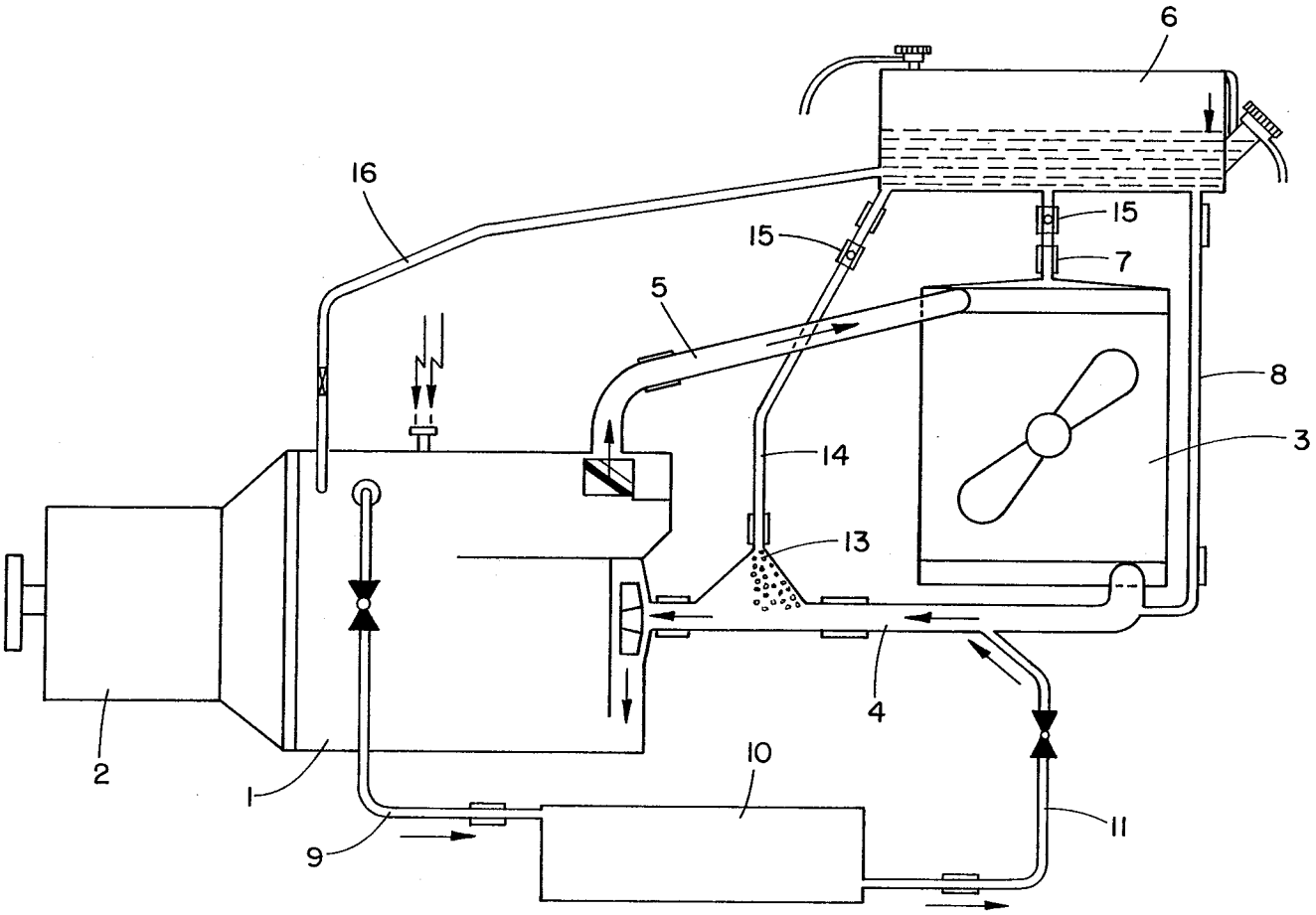
FIG. 1 is a diagrammatic view an automobile cooling system.

FIG. 1 shows an engine 1 with a transmission 2. It is connected via the lines 4 and 5 with a radiator 3. At a higher level than the radiator there is a cooling water level compensating tank 6 with a duct 7 opening into the radiator 3 and a further duct 8 opening into the line 4. A duct 9 branches from the engine 1 and runs to a heating element 10, whose outlet is connected via a line 11 with the line 4. In the line 4, just upstream from the water pump 12 connected with the engine 1, there is a bubble trap 13 which is conical and has a duct 14 extending from its apex to the cooling water level compensating tank 6. The ducts 7 and 14 have check valves 15 in them. De-aeration of the engine is via a duct 16.

Figure 2:
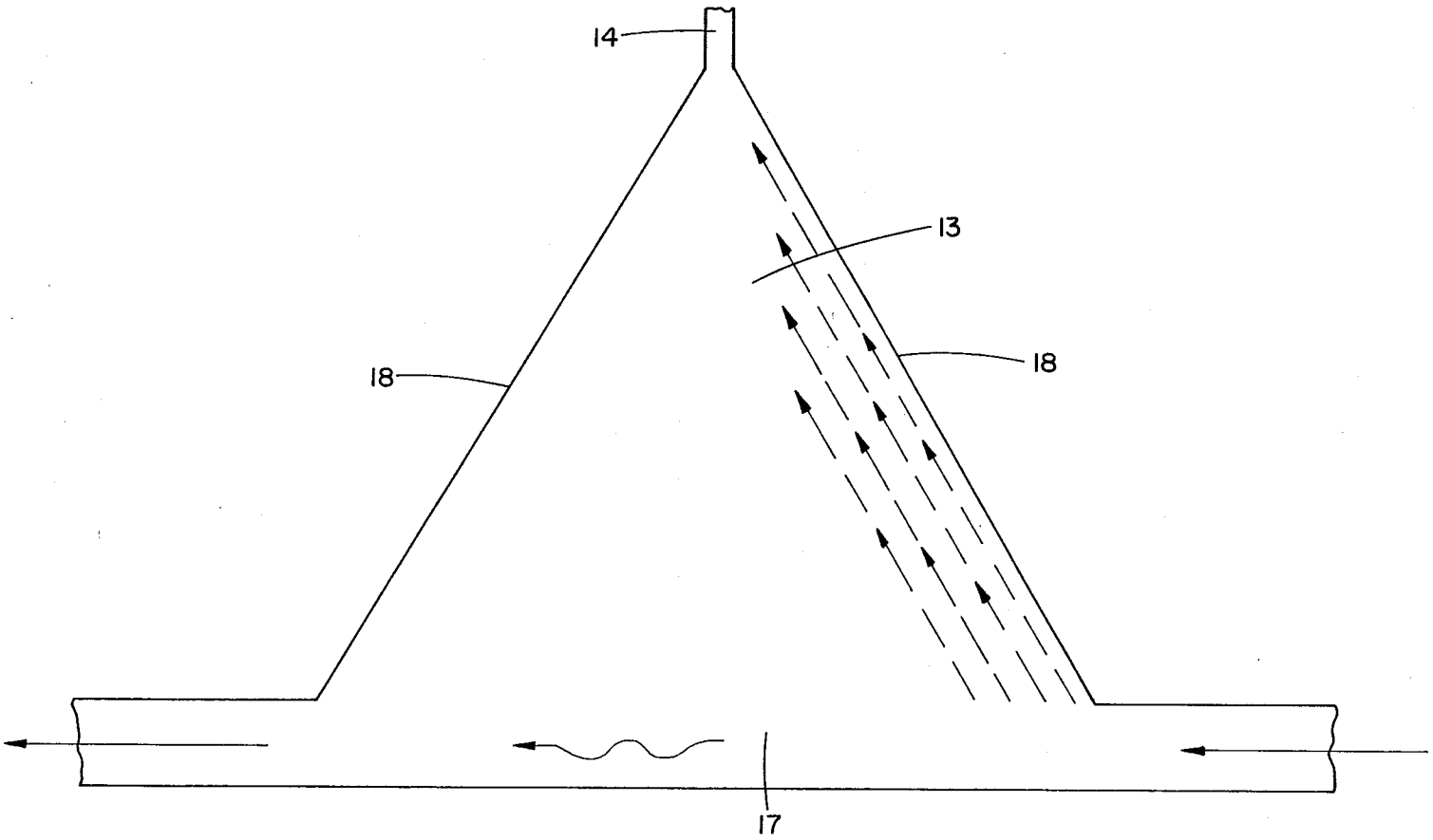
FIG. 2 is a diagram of a bubble trap.

FIG. 2 diagramatically shows a bubble trap 13 of conical design (18), the base 17 of the bubble trap at the same level as the line tapering upwards as far as the point at which it opens into the duct 14.

Figure 3:
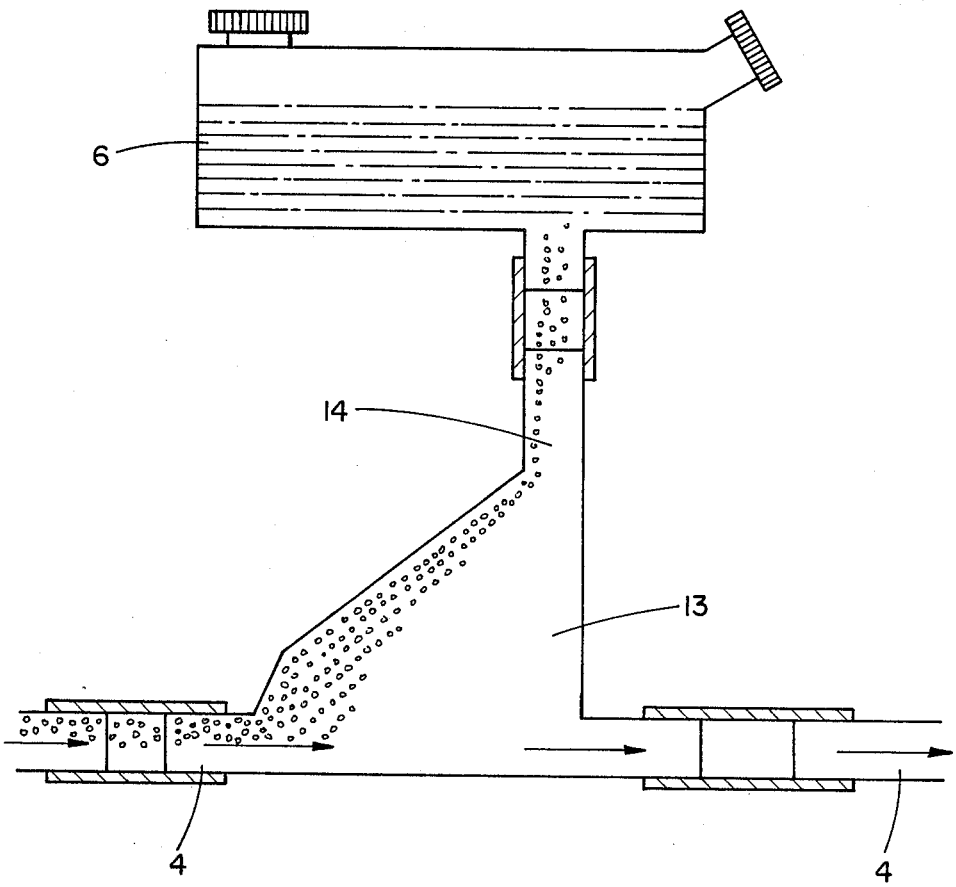
FIG. 3 is a diagrammatic drawing of a bubble trap with a coolant level compensating tank.

FIG. 3 shows a further version of the bubble trap 13 with an inclined wall 19 and an upright wall 20 so that the air bubbles may make their way along the inclined wall 19 to the duct 14 and then into the tank 6.

We claim:

1. A cooling system for a liquid-cooled internal combustion motor vehicle engine, which includes a radiator, water pump, liquid coolant level compensating tank, heater which is traversed by said liquid coolant, connecting elements, regulating elements, and a bubble separator disposed in a connector line between said radiator and said water pump, characterized in that a riser tube is provided on said bubble separator for the receipt of separated air, said riser tube connected at its end remote from said bubble separator to said liquid coolant level compensating tank, said compensating tank located at a level above said bubble separator, wherein said bubble separator is funnel-shaped such that said riser tube is connected at a neck portion of said funnel-shaped separator and a mouth portion of said funnel-shaped separator is connected in said connecting line between said radiator and said water pump.

2. The engine cooling system as claimed in claim 1 wherein said bubble separator is adapted to contain a quantity of the coolant three times the amount corresponding to the cross section of the inlet of the coolant pump.

3. The engine cooling system as claimed in claim 1 having an opening from the heater into a connecting duct from the radiator at a point thereon upstream from the bubble separator.

4. The engine cooling system as claimed in claim 3 wherein at the said connecting duct extending from the radiator the bubble separator is connected with the linking duct by an inclined wall and at the connecting duct extending from the coolant pump it is connected by a vertical wall.

* * * * *